United States Patent [19]

Kawashima

[11] Patent Number: 4,483,306

[45] Date of Patent: Nov. 20, 1984

[54] MAGNETO HAVING TRANSISTOR IGNITION CIRCUIT FOR ENGINES

[75] Inventor: Junichi Kawashima, Himeji, Japan

[73] Assignee: Ikeda Electric Mfg. Co., Ltd., Himeji, Japan

[21] Appl. No.: 395,664

[22] Filed: Jul. 6, 1982

[30] Foreign Application Priority Data

Jul. 20, 1981 [JP] Japan ..... 56-108093[U]

[51] Int. Cl.[3] ..... F02P 1/00

[52] U.S. Cl. ..... 123/631; 123/149 R; 123/149 A

[58] Field of Search ..... 123/631, 601, 602, 603, 123/599, 149 R, 149 A, 149 C, 149 D; 315/209 T

[56] References Cited

U.S. PATENT DOCUMENTS

| | | | |
|---|---|---|---|
| 3,484,677 | 12/1969 | Piteo | 123/149 A |
| 3,667,441 | 6/1972 | Cauil | 123/601 |
| 3,722,488 | 3/1973 | Swift | 123/149 D |

*Primary Examiner*—Ronald B. Cox

*Attorney, Agent, or Firm*—Armstrong, Nikaido, Marmelstein & Kubovcik

[57] ABSTRACT

A magneto for two-cycle engines comprises a rotor provided with a magnet and a pair of poles, and a stationary assembly including a U-shaped iron core having a pair of legs and an ignition coil wound around one of the legs. The magnetic circuit provided by the pair of core legs, the pair of poles and the magnet includes a magnetic path through the other leg which path is given an increased magnetic resistance by a gap portion. The gap portion is formed in the end face or a side face of the other leg or in one of the poles in the end face thereof opposed to the other leg.

2 Claims, 9 Drawing Figures

MAGNETO HAVING TRANSISTOR IGNITION CIRCUIT FOR ENGINES

BACKGROUND OF THE INVENTION

The present invention relates to a magneto which has a transistor ignition circuit for engines and which is adapted to prevent the engine from rotating reversely on starting.

Magnetos of this type comprise a rotor, such as a flywheel, provided with a magnet and a pair of poles, and a stationary assembly including a U-shaped iron core having a pair of legs and an ignition coil wound on one of the legs. The rotation of the rotor produces in the primary winding of the ignition coil a current, which is suddenly interrupted by a transistor, inducing a high voltage in the secondary winding to fire a spark plug. When the magneto is to be incorporated, for example, into a two-cycle engine, the air gap between the pair of core legs and the pair of poles must have a specified dimension. If the air gap is dimensionally inaccurate, there is the likelihood that the engine will start backward. Thus the magneto must be assembled with extremely high accuracy. More specifically stated, the ignition coil primary current has approximately the same wave form whether the rotor rotates positively or reversely, so that when the engine starts backward instantaneously, i.e. in the event of a kickback, a high voltage will be induced in the ignition coil at the very moment. If sparking occurs, the engine will continue reverse rotation.

Accordingly various devices have been proposed for preventing such reverse rotation. For example, a device is known which is adapted to electrically bring the magneto out of igniting operation upon detecting reverse rotation. Although the known device does not require high accuracy in assembling, the device necessitates an increased number of parts and is costly to make due to the use of the electric means.

SUMMARY OF THE INVENTION

An object of the present invention is to provide an improved magneto of the type described above wherein the magnetic path through one leg of a U-shaped core opposite to the coil carrying leg thereof is made to have an increased magnetic resistance without using any additional part to ingeniously utilize leakage flux for greatly inhibiting the ignition coil primary current in the event of reverse rotation of the engine and preventing the reverse rotation on starting.

Another object of the invention is to provide a magneto of the type described wherein the magnetic resistance of the path is increased by a simple structure without using any additional electric or other part and which can be manufactured at a low cost.

Still another object of the invention is to minimize the reduction of the igniting performance of the magneto during the normal rotation of the engine despite the increase of the magnetic resistance.

Other objects, features and advantages of the invention will become more apparent from the following description with reference to the accompanying drawings.

DESCRIPTION OF THE PREFERRED EMBODIMENTS

Figure 1:
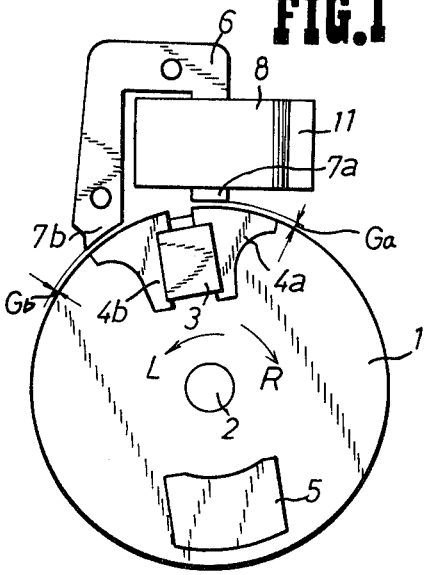
FIG. 1 is a front view showing a conventional magneto.
Figure 2:
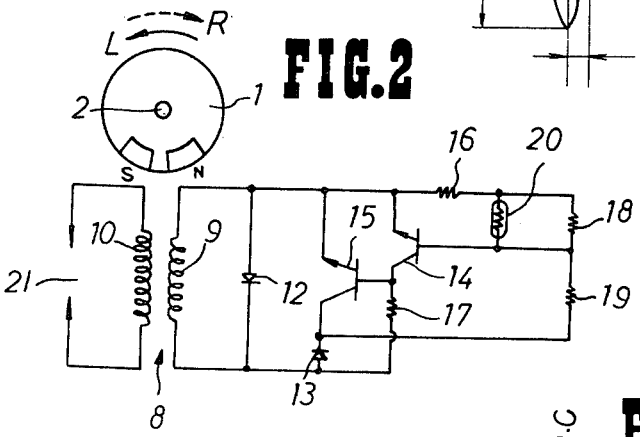
FIG. 2 is a diagram showing the ignition circuit included in the same.

FIG. 1 shows a conventional magneto having a transistor ignition circuit incorporated therein. With reference to FIG. 1, a rotor 1 is rotatable with the crankshaft 2 of an engine and is provided with a magnet 3, a pair of poles 4*a*, 4*b* and a flyweight 5. A U-shaped iron core 6 has a pair of legs 7*a*, 7*b* and is supported by a stationary member with its legs 7*a*, 7*b* opposed to the poles 4*a*, 4*b*. An ignition coil 8 is mounted on the leg 7*a* of the core 6. As seen in FIG. 2, the ignition coil 8 comprises a primary winding 9 and a secondary winding 10 and is molded integrally with a circuit unit 11 with synthetic resin or the like. As shown in FIG. 2, the circuit unit 11 comprises diodes 12, 13, transistors 14, 15, resistors 16, 17, 18, 19, thermistor 20, etc.

Figure 3:
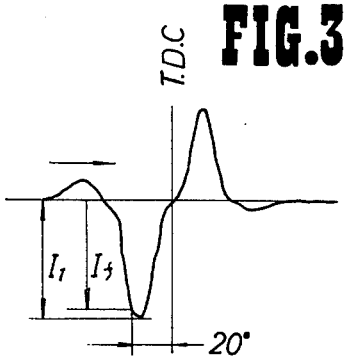
FIG. 3 is a diagram showing the wave form of current produced by the magneto during the normal rotation of its rotor.

When a recoil starter is pulled to start the engine and rotate the rotor 1 in the normal direction L, current Il, as shown in FIG. 3, flows through the primary winding 9 of the ignition coil 8. Upon the current reaching a value If, the transistor 15 is turned off abruptly to interrupt the primary current, consequently inducing a high voltage in the secondary winding 10 to cause a spark across a plug gap 21 for ignition.

Figure 4:
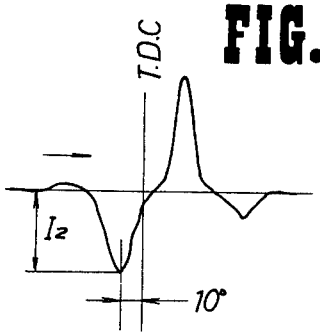
FIG. 4 is a diagram showing the wave form of current during reverse rotation.

However, magnetos of the type described involve the likelihood of permitting the engine to rotate reversely on starting. When the rotor 1 rotates in the normal direction, ignition is set about 20° in advance of the top dead center (T.D.C.) as illustrated in FIG. 3. When the engine is about to stop upon cranking, the rotor is likely to rotate reversely (in the direction of arrow R) instantaneously due to a kickback or like phenomenon, so that if sparking occurs across the spark gap 21 near the top dead center at this very moment, the engine will continue reverse rotation. In the case where reverse rotation occurs with the magneto shown in FIG. 1, ignition takes place about 10° in advance of the top dead center as shown in FIG. 4 because the current produced in the ignition coil 8 has substantially the same wave form whether the rotor rotates in the normal direction or in the reverse direction. This phenomenon inevitably occurs in the above arrangement wherein the magnet 3 for the rotor 1 has two poles, i.e. poles 4*a* and 4*b*, opposite to the two legs 7*a* and 7*b* of the core 6 having the ignition coil 8.

The reverse rotation phenomenon will be described below in greater detail. Even if an engine is equipped with the magneto of FIG. 1, reverse rotation occurs rarely or very infrequently. Usually the recoil starter is pulled strongly to start the engine in the normal direction to fire the spark plug about 20° in advance of the top dead center as shown in FIG. 3 and cause explosion within the cylinder. The engine thereafter rotates in the normal direction at a rapidly increasing speed. However, in the case where the engine will not start smoothly with the recoil starter pulled lightly, there is a very small likelihood that the first ignition occurs the moment the engine rotates backward, i.e. upon a kickback. The engine then rotates continuously reversely, and hence, is hazardous. The momentary speed of reverse rotation due to a kickback is very low; it is up to 1500 r.p.m. for about 10 to 50 cc two-cycle engines. Accordingly the continued reverse rotation of the engine can be prevented if the magneto is so adapted that it will not cause ignition at low speeds, for example, of up to 2000 r.p.m. when the engine rotates reversely.

A description will be given of the ignition characteristics in the event of reverse rotation. With reference to FIG. 1, the air gaps G*a*, G*b* between the rotor 1 and the core 6 are set within a specified range, for example, of 0.25 mm±0.01 mm when the magneto is incorporated into an engine. Naturally the magneto is designed not to permit rotation insofar as the gaps are thus set as specified. In other words, the adjusting resistor 19 of the circuit unit 11 is so determined as not to permit ignition at low speeds of up to 2000 r.p.m. However, if the air gaps are set to about 0.05 mm, a high current will be induced in the ignition coil 8 to cause ignition even at 1000 r.p.m. in the event of reverse rotation, consequently entailing continued reverse rotation although rarely.

In view of the foregoing problem heretofore encountered, the present invention provides a magneto which is adapted not to cause ignition at low speeds of reverse rotation of up to 2000 r.p.m. even when the air gaps are set, for example, at about 0.05 mm.

Throughout the accompanying drawings, like parts are referred to by like reference numerals.

Figure 5:
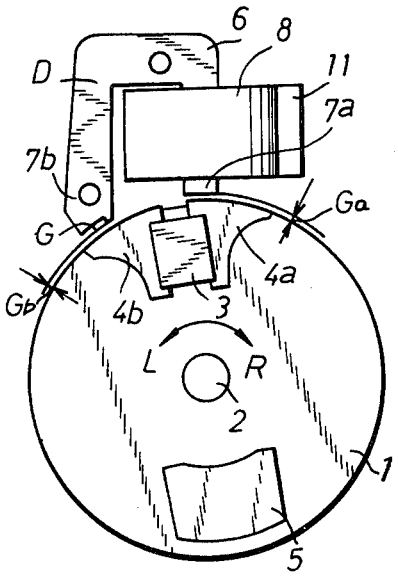
FIG. 5 is a front view showing a magneto embodying the invention.

FIG. 5 shows a preferred embodiment of the invention. The magneto comprises a U-shaped iron core 6 having a leg 7*a* provided with an ignition coil 8 and another leg 7*b* opposed to the leg 7*a* and cut out at its forward end to provide a gap portion G. The magnetic path through the leg 7*b* is made to have an increased magnetic resistance by the gap portion G. With the exception of this feature, the magneto has substantially the same construction as the one already described.

Figure 6:
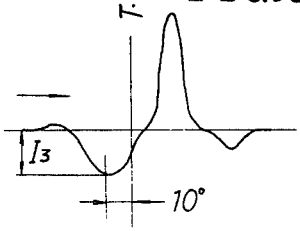
FIG. 6 is a diagram showing the wave form of current produced by the magneto of FIG. 5 during reverse rotation.

With this structure, the magnetic flux from the pole 4*b* to the leg 7*b* has difficulty in passing across the gap portion G during reverse rotation, greatly reducing the current through the primary winding 9 of the ignition coil 8 as indicated at I3 in FIG. 6. Thus the gap portion G formed serves to reduce the current from I2 in FIG. 4 to the smaller value I3 in FIG. 6 to thereby prevent ignition during reverse rotation. The value I3, which increases with the increase in the rotational speed of the rotor 1, reaches an ignition level at a speed of above 2000 r.p.m. However, since the momentary speed of reverse rotation is about 1000 r.p.m., the above structure prevents continued reverse rotation in any case. Since the value I3 is small, no particular trouble will result even when the magneto as incorporated into an engine involves some dimensional variation in the air gaps. The magneto is therefore easy to assemble. Further because the gap portion G in the leg 7*b* is in the form of a cutout, the gap portion is easy and inexpensive to make without necessitating any other additional part. Especially when the core 6 is an assembly of blanked steel plates joined together in layers, the gap portion G can be formed simultaneously when the plates are blanked out, so that the core with the gap portion can be made at the same cost as the conventional ones without necessitating any additional machining step.

If the above structure greatly impairs the characteristics of the magneto during normal rotation, the magneto will not be fully useful, whereas we have found that the reduction of the characteristics during normal rotation is about 6%. The reduction can be compensated for to such an extent as to be comparable to the characteristics of magnetos having no gap portion by varying the ratio in the number of turns between the windings of the ignition coil 8.

The very small reduction in the characteristics during normal rotation despite the presence of the gap portion G is attributable to the following reason. With reference to FIG. 5 showing the position of the rotor 1 in normal rotation relative to the ignition coil 8, etc., the gap portion G increases the magnetic resistance between the leg 7*b* and the pole 4*b* while increasing the leakage flux from the D portion of the core 6 to the pole 4*b*, with the result that the leakage flux acts as an effective flux for the ignition coil 8 during normal (forward) rotation.

While FIGS. 3, 4 and 6 show current wave forms all at 1000 r.p.m. for comparison, I2 is smaller than I1 because there is a leakage flux from the D portion to the pole 4*b* although the gaps G*a* and G*b* are dimensionally identical in FIG. 1. The present invention ingeniously utilizes the effect of the leakage flux.

Figure 7:
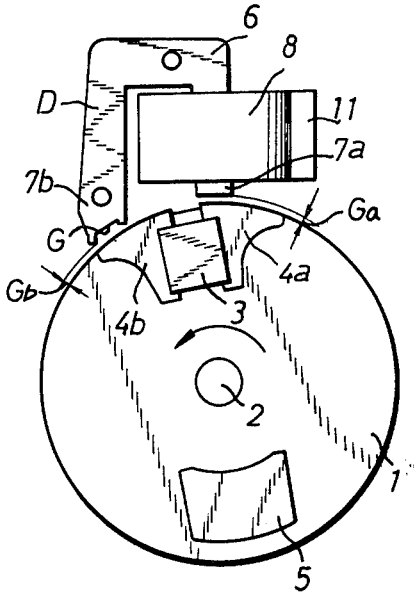
FIGS. 7 to 9 are front views showing other embodiments of the invention.

The gap portion G, which is formed asymmetrically in the end face of the leg 7*b* as shown in FIG. 5, may alternatively be formed symmetrically in the center of the end face of the leg 7*b* as seen in FIG. 7.

Figure 8:
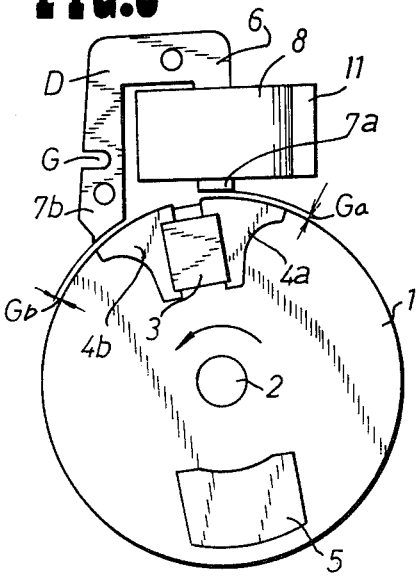

FIG. 8 shows a gap portion G formed in the leg 7*b* of the core 6 and positioned away from the lengthwise midportion of the leg 7*b* closer to its forward end. The gap portion G is formed in the shape of a cutout in one side of the leg 7*b* opposite to the other side thereof which faces the leg 7*a* to reduce the area of the magnetic path through the leg 7*b* and give an increased magnetic resistance.

Figure 9:
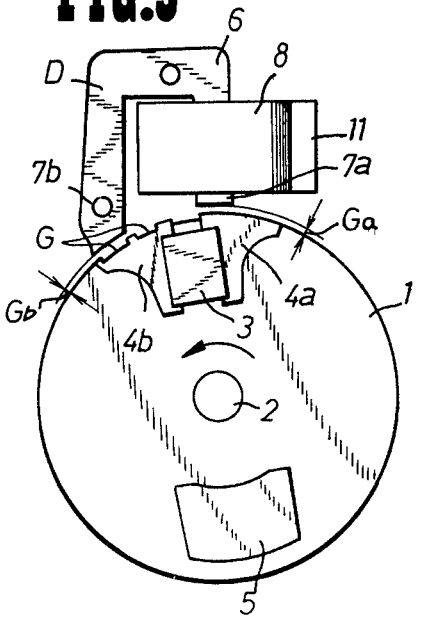

FIG. 9 shows gap portions G each in the form of a cutout and formed in the end face of one of the pair of poles 4*a*, 4*b*, i.e. the pole 4*b*, which face is opposed to the leg 7*b*. Although one or a plurality of gap portions may be provided in this case, it is more preferable to form a plurality of small separate gap portions than to form a single large gap portion.

What is claimed is:

1. In a magneto and transistor ignition circuit for engines which comprises a rotor provided with a magnet having a pair of poles, and a stationary assembly including a U-shaped iron core having first and second legs forming a magnetic path, an ignition coil having primary and secondary windings wound around said first leg and a transistor connected to said primary winding and so arranged that current induced in said primary winding when the rotor is rotated is interrupted by turning off of the transistor to induce a high voltage in said secondary winding, the improvement to prevent ignition during reverse rotation comprising a gap portion formed in said magnetic path of said second leg to substantially reduce the area of the magnetic path and thereby cause increased magnetic resistance in said magnetic path.

2. A magneto as defined in claim 1, wherein said gap portion is provided between the end portion of said second leg and the pole adjacent thereto by partly cutting out a substantial portion of the end face of said second leg to make the area of its magnetic path substantially smaller than that of said first leg.

* * * * *